United States Patent [19]

Puschkarski

[11] 3,990,176

[45] Nov. 9, 1976

[54] LIFE-LIKE TOY ANIMAL

[76] Inventor: Felix Puschkarski, Hardtgasse 8 (Tur 21), A-Wien 19, Austria

[22] Filed: Sept. 6, 1973

[21] Appl. No.: 394,675

[30] Foreign Application Priority Data

Sept. 13, 1972 Germany ..... 7233769[U]

[52] U.S. Cl. ..... 46/116; 46/123; 46/152; 272/8 N

[51] Int. Cl.[2] ..... A63H 7/02

[58] Field of Search ..... 46/151, 123, 152, 154, 46/156, 124, 126; 273/1 R; 272/8 N, 8 R, 27 R, 27 N

[56] References Cited

UNITED STATES PATENTS

| | | | |
|---|---|---|---|
| 1,571,381 | 2/1926 | Sherman | 272/8 N |
| 2,138,280 | 11/1938 | Kyser | 46/123 |
| 2,474,236 | 6/1949 | Durbin | 46/151 |
| 2,687,887 | 8/1954 | Frampton | 272/27 R |
| 2,725,670 | 12/1955 | Hodes | 272/8 R X |
| 2,974,954 | 3/1961 | Martin | 272/8 R |

OTHER PUBLICATIONS

Hopkins; Albert A., "Magic"; Munn & Co., Publishers, New York, N.Y. (1906), p.136.

Hopkins; Albert A., "Magic", Munn & Co., Publishers, New York, N.Y. (1906), p. 135.

*Primary Examiner*—F. Barry Shay

*Attorney, Agent, or Firm*—Burgess Ryan and Wayne

[57] ABSTRACT

A life-like toy animal in the form of a flexible elongated core made of flexible cord is provided with fluffy hairlike material extending outward from the core by a distance that diminishes from one end of the core to the other. A simulated pair of eyes and a nose connected to the wider end of the elongated body are attached to a thin thread that may be connected to the clothing of the user.

1 Claim, 1 Drawing Figure

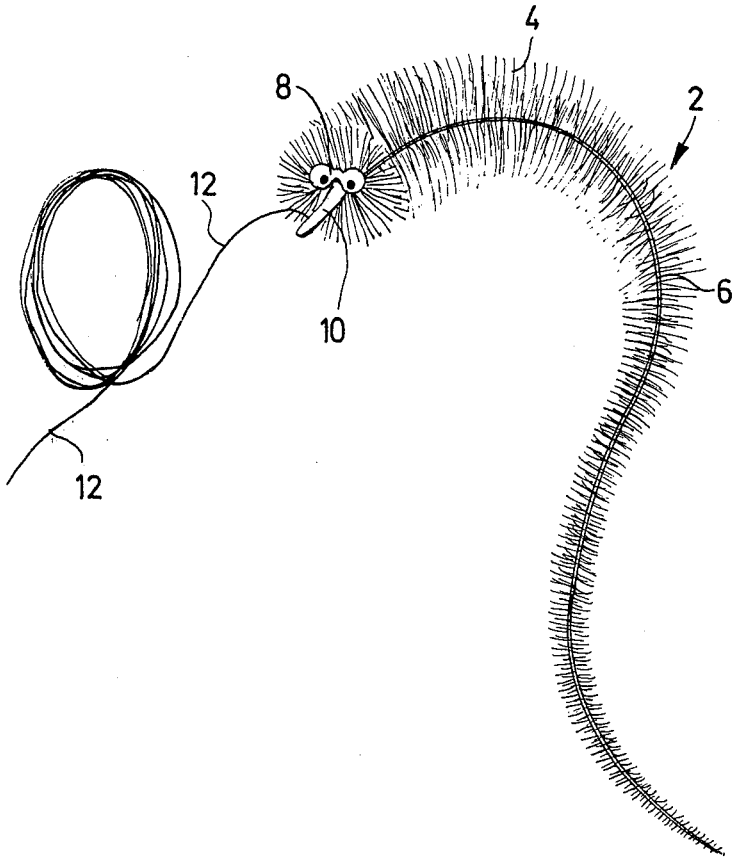
4
8
2
12
6
10
12

LIFE-LIKE TOY ANIMAL

The invention relates to a life-like toy animal, that is to say a toy animal with which a user can create the amazing impression that the animal is alive although a spectator immediately becomes aware that it is a toy animal which is not actually alive.

The life-like toy animal in accordance with the invention is characterized in that the toy animal is attached to a thread that is fixed, for example on the clothing of the user or person exhibiting the animal. The thread is preferably thin and practically invisible.

Since the toy animal is attached to the thread, the user can use suitable hand movements to cause the animal to run over his hand and the impression is created that the toy animal itself is moving. The user can place the animal in his jacket sleeve, from which on a suitable movement of the arm it appears to come out of its own accord.

The surprising effect is then still further enhanced if the toy animal is in fact not an exact natural reproduction of a living animal. Otherwise the spectator could think that it was possibly actually a living animal. For this reason, an elongated fluffy tail is preferred as a toy animal. A further advantage in the case of the use of a fluffy tail as a toy animal is due to the fact that only a minimum amount of skill with the fingers is necessary in order to make the fluffy tail "come alive".

Finally, it is also advantageous if the fluffy tail has a very flexible cord as a core, from which the fluffy hairs stand out. As a result, the fluffy tail as a whole becomes flexible so that it can assume different shapes and makes a still more life-like impression.

The nature of the present invention will become more clearly apparent from the following description of the accompanying drawing which shows a preferred embodiment of the toy animal.

In the drawing, a toy animal is shown comprising a fluffy tail 2 consisting of fluffy hair 4 and a very flexible cord 6 as a core. For producing the tail 2, a so-called chenille can be used. The hair of a length of such a chenille material is cut to have a maximum length near one end, i.e. the head end, and a minimum length at the opposite end of the tail 2. At the head end, there is affixed a piece of paper 8 or plastic material on which two black points are printed to form the eyes of the animal. Also at the head end, the hair of the chenille is cut or pressed to form a nose 10.

On the nose 10, is affixed a thread 12 which is very thin, practically invisible, however, sufficiently strong to serve the purpose described above.

It will be understood that modifications may be made in the particular features of the animal which have been described above for illustrative purposes without departing from the scope of the invention as defined by the following claims.

I claim:

1. A life-like toy animal comprising means whereby the animal as a whole is flexible so that it can assume different shapes and make a life-like impression, said means comprising an elongated body made of a flexible cord, and fluffy hair-like material extending from said cord by a distance that gradually diminishes from one end of the body to the other, the length of said animal being substantially greater than its thickness, said animal further comprising a pair of simulated eyes provided on said one end of the body, a simulated nose at said one end of the body, and a thin thread attached to the nose of the toy animal for connecting the animal to the clothing of the user, said thread being sufficiently long to enable movement of said animal by manipulative movement of the hands or arms of a user.

* * * * *